US006294224B1

(12) United States Patent
Akedo et al.

(10) Patent No.: US 6,294,224 B1
(45) **Date of Patent: *Sep. 25, 2001**

(54) METHOD FOR ARRANGING OF NON-MAGNETIC SUBSTANCE

(75) Inventors: Jun Akedo; Tetsuya Suto, both of Tsukuba (JP)

(73) Assignee: Director-General of Agency of Industrial Science and Technology, Government Agency of Japan, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/145,535

(22) Filed: Sep. 2, 1998

(30) Foreign Application Priority Data

Sep. 3, 1997 (JP) ..... 9-237934

(51) Int. Cl.[7] ..... H01F 1/00

(52) U.S. Cl. ..... 427/547; 427/131; 427/271; 427/598

(58) Field of Search ..... 427/598, 131, 427/547, 271

(56) References Cited

FOREIGN PATENT DOCUMENTS 92 22150 8/1997 (JP) .

*Primary Examiner*—Bernard Pianalto
(74) *Attorney, Agent, or Firm*—Martin A. Farber

(57) ABSTRACT

A non-magnetic substance particle arrangement method is provided which can regularly arrange non-magnetic substance particles such as abrasive particles very easily and very cost effectively and can be applied to techniques such as micro grinding work, micro component assembly, and micro decorating work. The method includes the steps of: coating a magnetic fluid mixed with the non-magnetic substance particles on a surface of a magnetic recording medium recorded with a magnetic pattern; and applying a uniform d.c. magnetic field or an a.c. magnetic field superposed upon the d.c. magnetic field to the surface of the magnetic recording medium to form the non-magnetic substances in an in-plane of the magnetic recording medium or cubically on the magnetic recording medium.

15 Claims, 11 Drawing Sheets

(EXTERNAL MAGNETIC FIELD NOT APPLIED)

(EXTERNAL MAGNETIC FIELD APPLIED IN IN-PLANE DIRECTION OF SUBSTRATE)

$1 \leqq \lambda / d \leqq 10$ $10 \leqq \lambda / d$

LEAKAGE MAGNETIC FIELD OF MAGNETIC RECORDING MEDIUM
HR = O

EXTERNALLY APPLIED MAGNETIC FIELD
H = 300 Oe $1 \leqq \lambda / d \leqq 10$

LEAKAGE MAGNETIC FIELD OF MAGNETIC RECORDING MEDIUM

HR = 300 Oe

EXTERNALLY APPLIED MAGNETIC FIELD

H = 300 Oe $1 \leqq \lambda / d \leqq 10$

LEAKAGE MAGNETIC FIELD OF MAGNETIC RECORDING MEDIUM
HR = 400 Oe

EXTERNALLY APPLIED MAGNETIC FIELD
H = 300 Oe $1 \leqq \lambda / d \leqq 10$

LEAKAGE MAGNETIC FIELD OF MAGNETIC RECORDING MEDIUM HR = 400 Oe

EXTERNALLY APPLIED MAGNETIC FIELD H = 300 Oe

METHOD FOR ARRANGING OF NON-MAGNETIC SUBSTANCE

BACKGROUND OF THE INVENTION a) Field of the Invention

The present invention relates to a method of arranging or configuring non-magnetic substances such as non-magnetic particles. The invention is applicable to technical fields of micro grinding work, micro component assembly, and micro decorating work.

b) Description of the Related Art

A grindstone to be used for a micro grinding work is made of diamond abrasive grains having a diameter of several $\mu$m or smaller fixed together with binder such as resin. Conventionally, a distribution of diamond abrasive grains on the surface of a grindstone has not be controlled but is left at random. It has been found recently that if diamond abrasive grains are arranged regularly, the precision and efficiency of a grinding work can be improved considerably. However, a work of holding and handling a large number of diamond abrasive grains one grain after another is not practical from the viewpoint of work cost. A method has been proposed by which magnetic material is coated on each diamond abrasive grain and coated grains are forcibly arranged by a magnetic force of a magnetic field externally applied. It is, however, very high in cost to coat a magnetic material on a diamond abrasive grain, and moreover since the amount of magnetic material coated on the grain is small, a arrangement or configuration of abrasive grains is not achieved unless a. high magnetic field of about 1 T is applied. In assembling micro mechanical components of a micro machine presently under development, it is necessary to align the directions of these micro components and arrange them regularly. Most of these micro components are often made of non-magnetic substance. Also in the field of micro decorating work, it is necessary to control the distribution of non-magnetic particles such as diamond particles. Adequate techniques of easily handling such non-magnetic particles such as diamond particles have not been developed as yet.

The present inventor has developed a non-magnetic substance arrangement method (refer to the specification and drawings of JP-A-9-222150 entitled "Non-Magnetic Substance Arrangement Method"). The contents of the developed non-magnetic substance arrangement method disclose that non-magnetic particles are mixed with a magnetic fluid and the surface of a substrate is coated with the magnetic fluid. A uniform d.c. magnetic field is applied vertically or horizontally to the substrate, or an a.c. magnetic field superposed upon the d.c. magnetic field is applied, to thereby arrange or configure the non-magnetic particles in an in-plane of the substrate or cubically. The developed non-magnetic substance arrangement method can regularly arrange non-magnetic particles such as abrasive particles very easily and very cost effectively and can be applied to techniques such as micro grinding work, micro component assembly, and micro decorating work. With the developed non-magnetic substance arrangement method, however; the arrangement interval $\lambda$ of particle chains depends upon various factors such as a size and specific gravity of a particle, a particle concentration in the magnetic fluid, an interface state between particles, and an externally applied magnetic field intensity. Therefore, it is difficult and unstable to control the arrangement of non-magnetic particles only by the intensity of an externally applied uniform magnetic field. In particular, if the amount of non-magnetic particles contained in the magnetic fluid increases, adjacent non-magnetic particle chains may couple each other. In this case, a practically usable control is difficult.

SUMMARY OF THE INVENTION

The invention has been made under the above circumstances. It is an object of the present invention to provide a method of arranging non-magnetic substances capable of arranging non-magnetic particles very easily and cost effectively, being applied to technical fields of micro grinding work, micro component assembly, and micro decorating work, and being easy to control the arrangement interval between non-magnetic particle chains.

In order to achieve the above object of the invention, there is provided a method of arranging non-magnetic substances, comprising the steps of: coating a magnetic fluid mixed with the non-magnetic substances on a surface of a magnetic recording medium recorded with a magnetic pattern; and applying a uniform d.c. magnetic field or an a.c. magnetic field superposed upon the d.c. magnetic field to the surface of the magnetic recording medium to form the non-magnetic substances in an in-plane of the magnetic recording medium or cubically on the magnetic recording medium.

DETAILED DESCRIPTION OF THE PREFERRED EMBODIMENTS

Figure 1A:
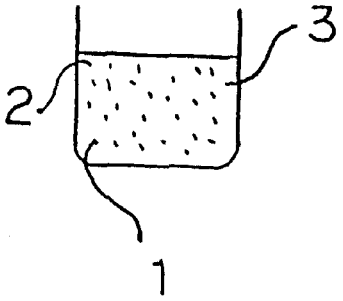
FIGS. 1A, 1B and 1C are diagrams illustrating the processes of arranging non-magnetic particles.
Figure 1B:
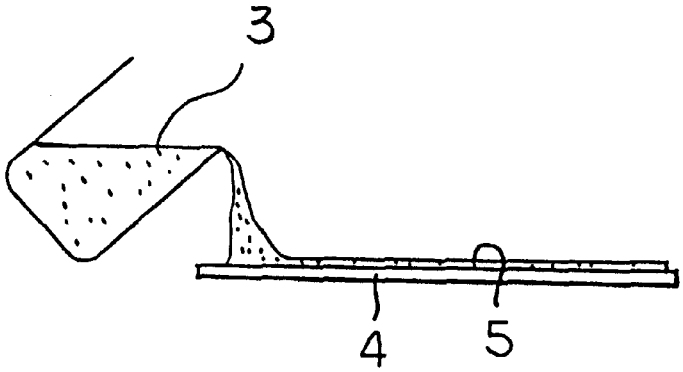
Figure 1C:
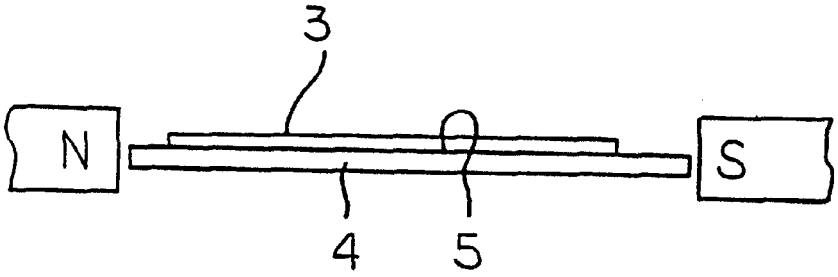

An embodiment of the invention will be described with reference to the accompanying drawings. First, the principle of a non-magnetic particle arrangement method will be described. As shown in FIGS. 1A to 1C, non-magnetic particles 1 to be arranged are mixed with a magnetic fluid 2 to form a mixed fluid 3 (FIG. 1A), and the mixed fluid 3 is coated on the surface 5 of a substrate 4 (FIG. 1B). The surface 5 of the substrate 4 is a flat surface or a curved surface and is constituted of a magnetic recording medium recorded with a magnetic pattern. Next, a uniform and horizontal d.c. magnetic field H in parallel to the surface 5 of the substrate 4 is externally applied to the surface 5 of the substrate (FIG. 1C).

Figure 2:
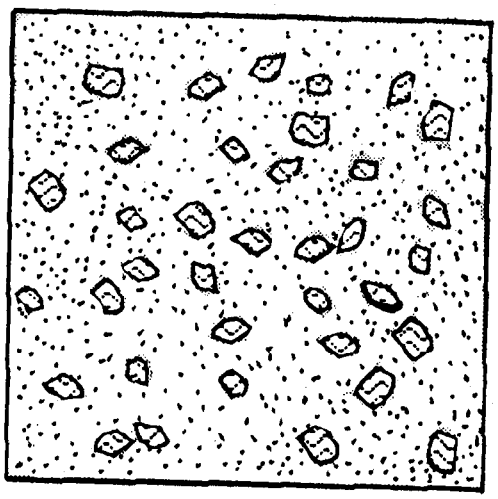
FIG. 2 is a diagram illustrating a distribution state of non-magnetic particles when an external magnetic field is not applied.
Figure 3A:
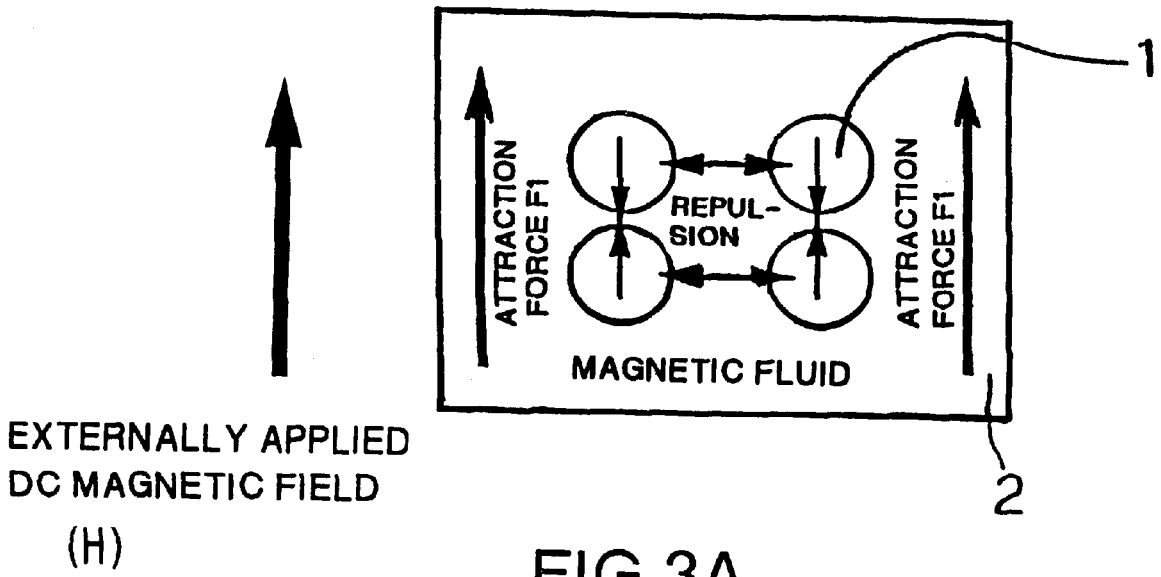
FIGS. 3A and 3B are diagrams illustrating a distribution state of non-magnetic particles when an external magnetic field is applied along an in-plane direction of a substrate.
Figure 3B:
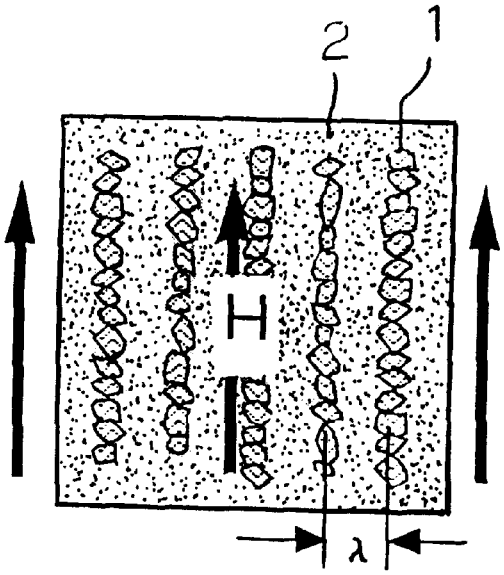

For the simplicity of description, it is assumed that the surface 5 of the substrate 4 is not made of a magnetic recording medium recorded with a magnetic pattern, but is made of a general non-magnetic material substrate and therefore no leakage magnetic field is applied from the substrate 4 to the mixed fluid 3. Assuming this condition, the arrangement state of non-magnetic particles will be described. If an magnetic field (H) is not externally applied to the surface 5 of the substrate 4, a distribution of non-magnetic particles 1 on the surface 5 of the substrate 4 is at random as shown in FIG. 2. However, if a magnetic field (H) in parallel to the substrate 4 is externally applied to the surface 5 of the substrate 4 (FIG. 1C), an attraction force is imparted to two non-magnetic particles in parallel to the direction of the magnetic field and a repulsion force is imparted to two non-magnetic particles perpendicular to the direction of the magnetic field, as shown in FIG. 3A. Therefore, the non-magnetic particles are arranged in the form of chain linearly disposed along the direction perpendicular to the direction of the magnetic field (FIG. 3B). This is the principle of the non-magnetic particle arrangement method. As described earlier, it is however difficult and unstable in some cases to control the arrangement interval between micro particle chains by the intensity of only the uniform magnetic field externally applied.

Figure 4A:
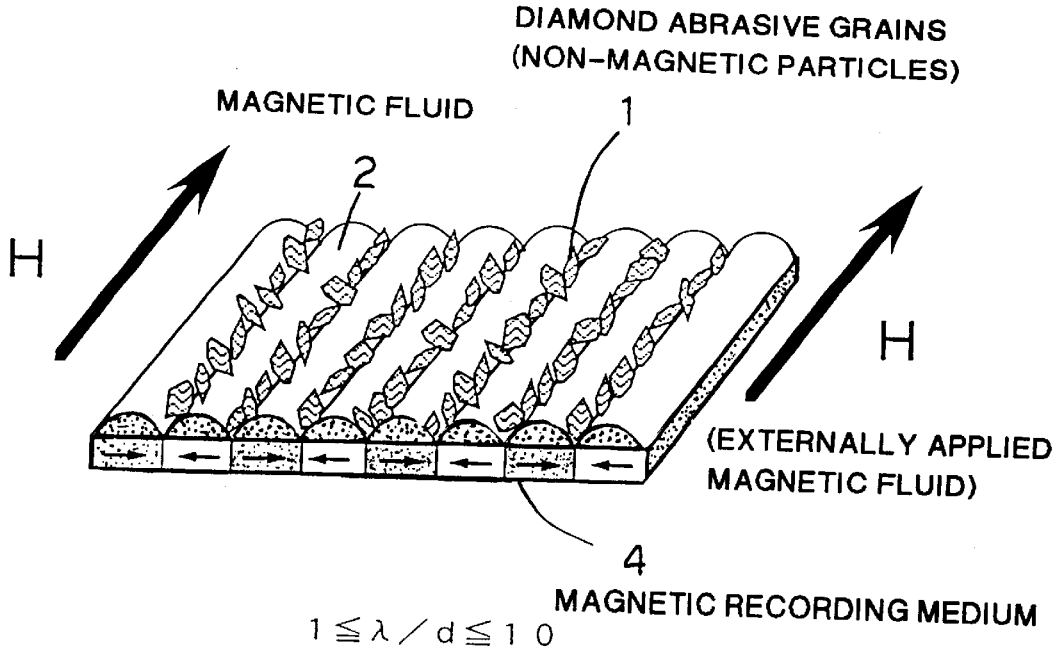
FIGS. 4A and 4B are schematic diagrams illustrating a distribution state of non-magnetic particles when a magnetic recording medium is used.
Figure 4B:
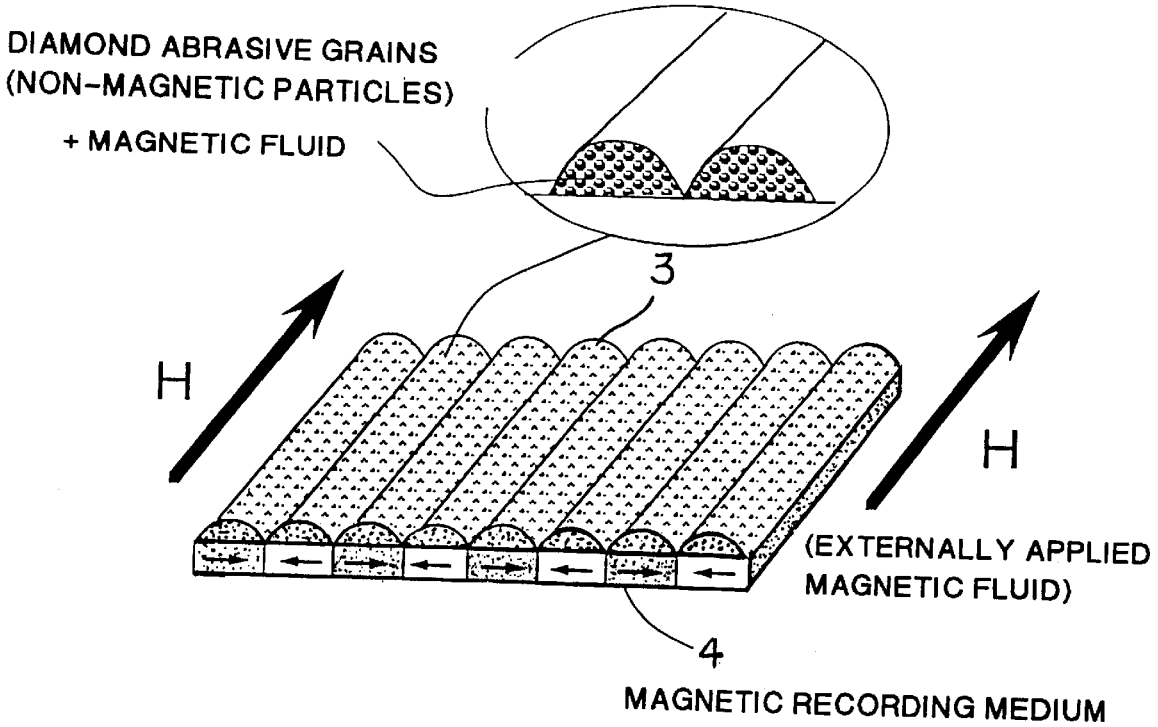

According to the present invention, the surface 5 of the substrate 4 with the magnetic fluid 2 mixed with the non-magnetic particles 1 being coated is constituted of a magnetic recording medium recorded with a magnetic pattern in advance. The uniform external magnetic filed H passing through the magnetic fluid is therefore modulated by the leakage magnetic field from the magnetic recording medium. In this case, as shown in FIG. 4A, the arrangement of non-magnetic particles is regulated by the magnetic pattern so that the interval between chains can be controlled reliably to have the period of stripes of the magnetic pattern of the magnetic recording medium. The period ($\lambda$, $\lambda/2$) is preferably set-so that a ratio ($\lambda/d$) is in a range from 1 or larger to 10 or smaller, where d is a diameter of a non-magnetic particle. For example, If non-magnetic particles are abrasive particles, by controlling the arrangement interval (period) $\lambda$ as above, an efficient grindstone surface can be formed which is difficult to have dulling of various kinds of abrasive substances. If the ratio $\lambda/d$ is set 10 or larger, the non-magnetic particles are distributed by the interface deformation between the magnetic fluid films themselves caused by the magnetic field, to thereby form a cubic arrangement as shown in FIG. 4B.

If the magnetic fluid films in this state are solidified, a surface, e.g., a grinding surface, made of an aggregation of non-magnetic particles and having a surface rich in variety can be formed. A micro work can be performed quickly by grinding with such a grindstone.

If an a.c. magnetic field is superposed upon the d.c. magnetic field, it is possible to decouple unsatble aggregation of micro particles or micro compoments formed before they are mixed in the magnetic fluid. It is therefore possible to arrange each micro particle or micro componement more reliably. [Experiment Examples]

Experiments of arranging diamond particles were conducted.

(Experiment Conditions)

Magnetic Recording Medium

Residual Magnetic Flux Br: 2500 Gausses

Coercive Force Hc: 1.4 K Oe

Leakage Magnetic Field HR: 300 Oe, 400 Oe

Externally Applied Magnetic Field Intensity H: 300 Oe

Diamond Grain Diameter d: 6 $\mu$m

Stripe Pattern Interval $\lambda$: 25 $\mu$m (Experiment Results)

(1) Arrangement of Diamond particles by Conventional Techniques

Figure 5:
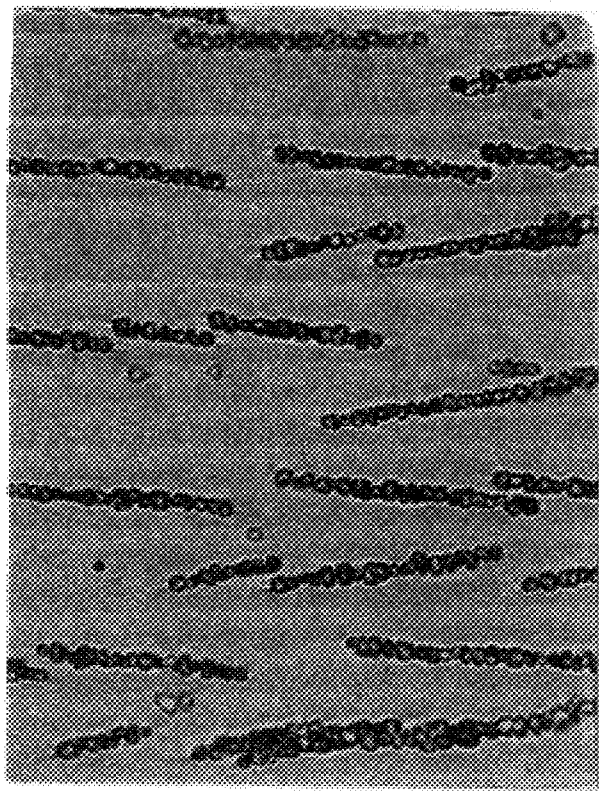
FIG. 5 is a microscopic photograph showing an in-plane arrangement of diamond particles according to a conventional technique.

If a magnetic recording medium recorded with a magnetic pattern was not used, i.e., if the leakage magnetic field intensity HR was set to 0 and the externally applied magnetic field H was set to 300 Oe, a good arrangement of diamond particles was not formed (refer to FIG. 5).

(2) In-plane Arrangement of Diamond Particles by the Invention (1)

Figure 6:
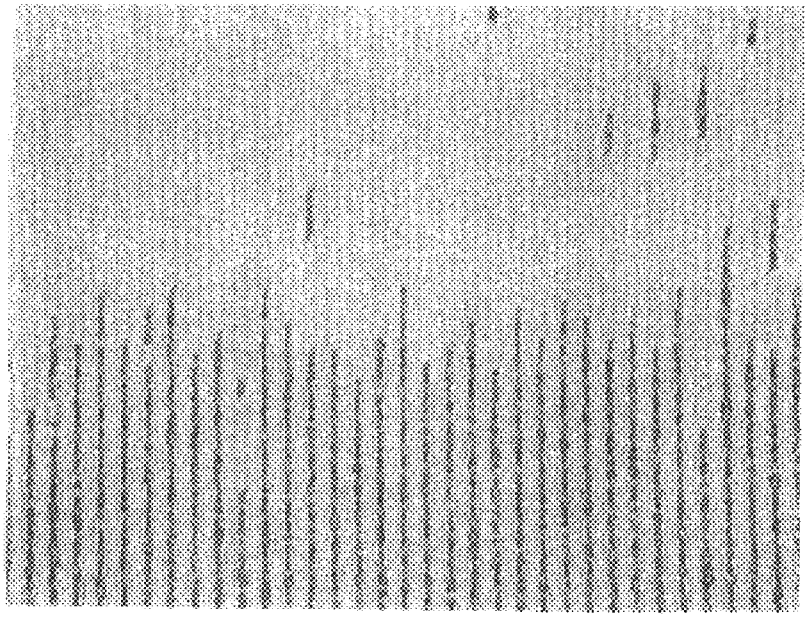
FIG. 6 is a microscopic photograph showing an in-plane arrangement of diamond particles according to the present invention.
Figure 7:
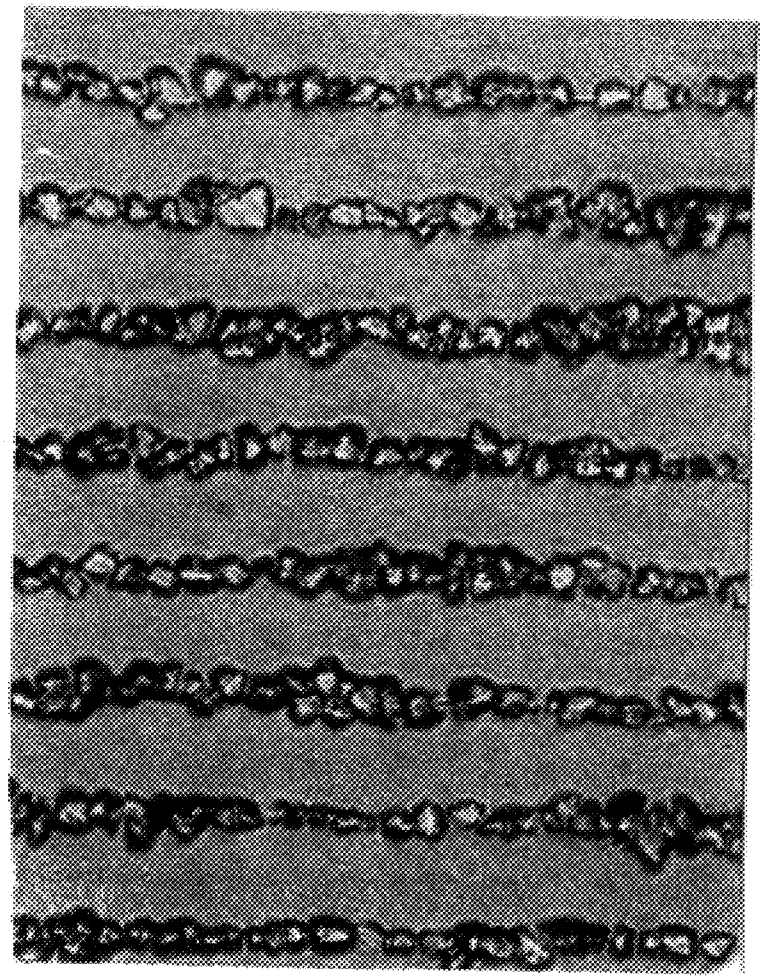
FIG. 7 is a microscopic photograph enlarging the microscopic photograph shown in FIG. 6.
Figure 8:
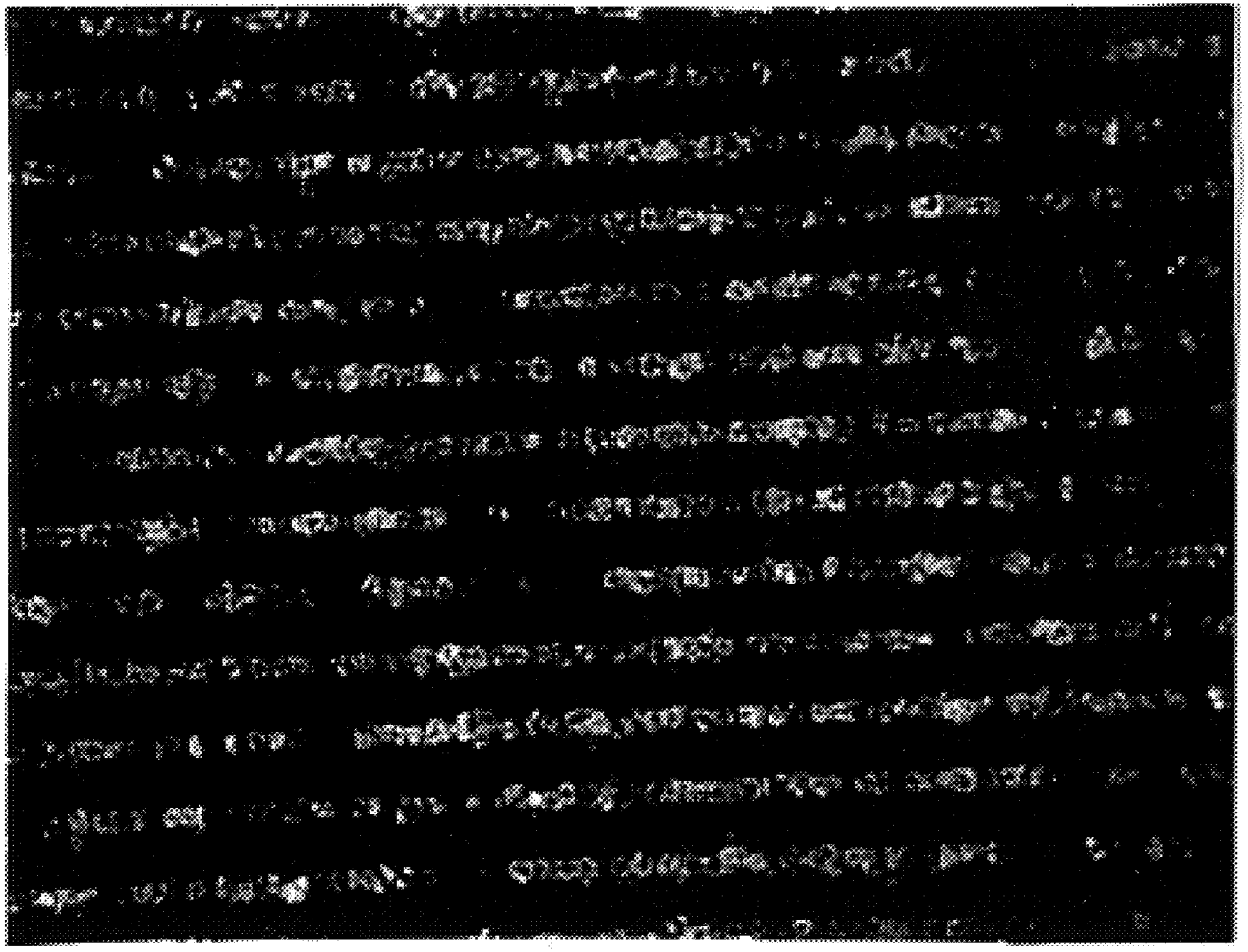
FIG. 8 is a microscopic photograph as a dark field image of the microscopic photograph shown in FIG. 6.

If a magnetic recording medium recorded with a magnetic pattern was used, i.e., if the leakage magnetic field intensity HR is set to 300 Oe, the externally applied magnetic field H is set to 300 Oe, and diamond particles under the conditions of $1 \leqq \lambda/d \leqq 10$ were used, a good in-plane arrangement of diamond particles was formed (refer to FIG. 6, FIG. 7 (an enlarged photograph of FIG. 6, and FIG. 8 (a dark field image of FIG. 6)).

(3) In-plane Arrangement of Diamond Particles by the Invention (2)

Figure 9:
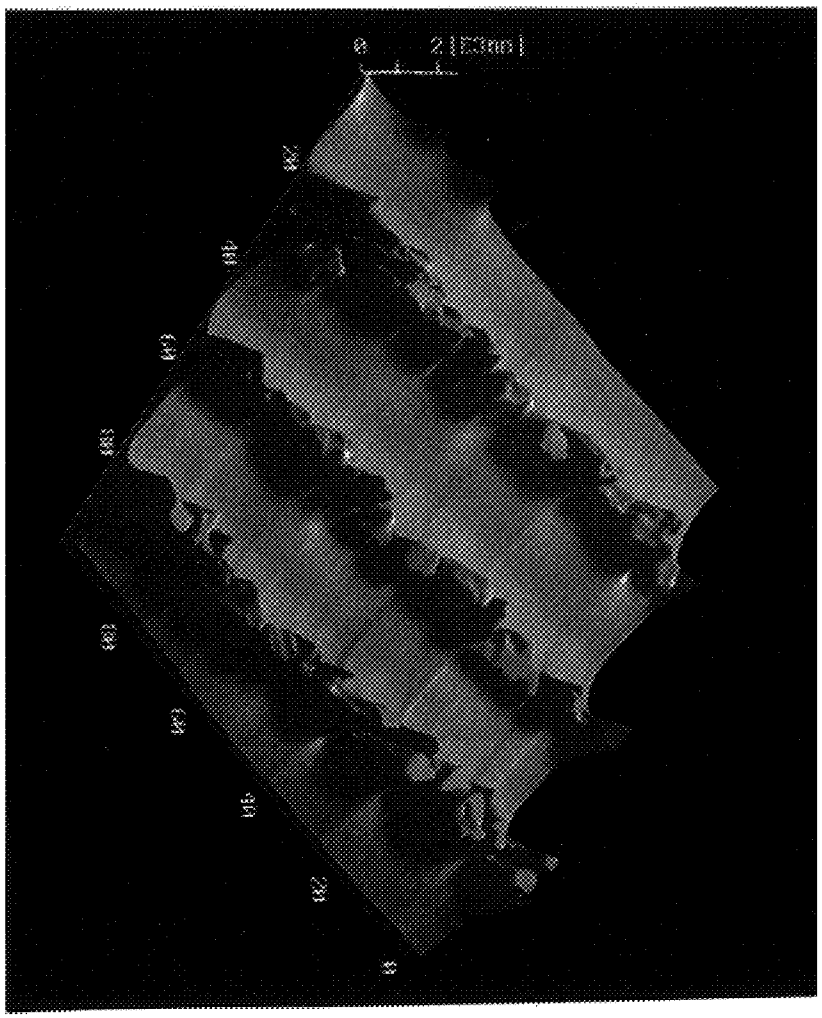
FIG. 9 is a microscopic photograph showing another in-plane arrangement of diamond particles according to the present invention.

If a magnetic recording medium recorded with a magnetic pattern was used, i.e., if the leakage magnetic field intensity HR is set to 400 Oe, the externally applied magnetic field H is set to 300 Oe, and diamond particles under the conditions of $1 \leqq \lambda/d \leqq 10$ were used, a good in-plane arrangement of diamond particles was formed (refer to FIG. 9).

(4) Cubic Arrangement of Diamond Particles by the Invention

Figure 10:
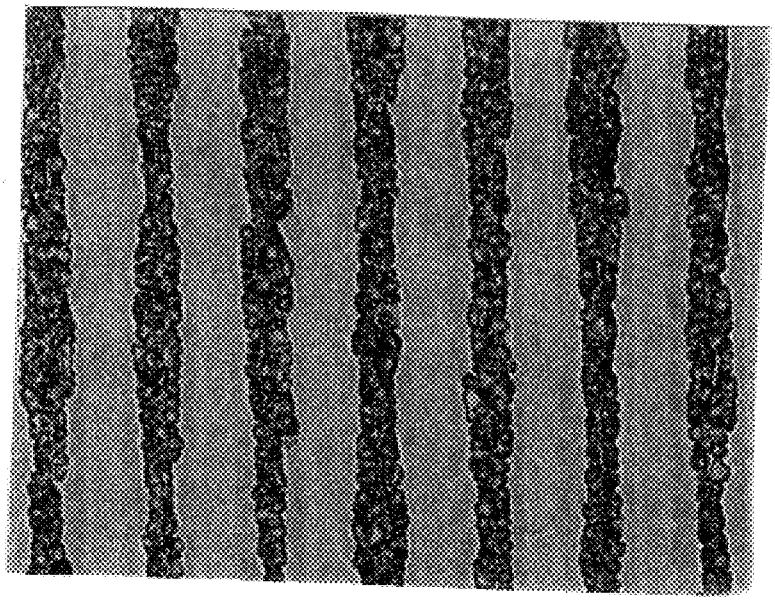
FIG. 10 is a microscopic photograph showing a cubic arrangement of diamond particles according to the present invention.
Figure 11:
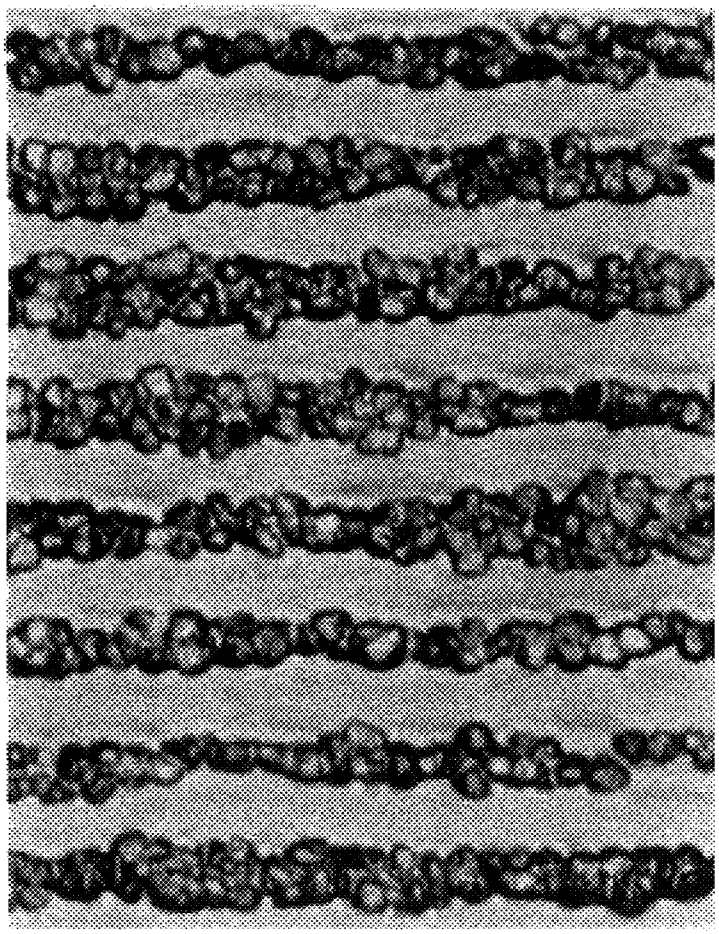
FIG. 11 is a microscopic photograph enlarging the microscopic photograph shown in FIG. 10.

If a magnetic recording medium recorded with a magnetic pattern was used, i.e., if the leakage magnetic field intensity HR is set to 400 Oe, the externally applied magnetic field H is set to 300 Oe, and diamond particles under the conditions of $10 \leqq \lambda/d$ were used, a good cubic arrangement of diamond particles was formed (refer to FIG. 10 and FIG. 11 (an enlarged photograph of FIG. 10)).

According to the non-magnetic particle arrangement method of this invention, a leakage magnetic field from a magnetic recording medium recorded with a magnetic pattern is utilized to regulate the arrangement interval between non-magnetic particle chains and control the arrangement of non-magnetic particles. For example, if the invention is applied to a grindstone, it is possible to dispose non-magnetic particles regularly in a ultra micro grinding grindstone which uses micro abrasive grains having a diameter of several $\mu$m or smaller. It is therefore possible to suppress dulling even if the grain diameter is made small to grind highly precisely, and to elongate the lifetime of the grindstone. Further, since the direction and interval of abrasive grain chains can be controlled uniformly, the function of each abrasive grain becomes similar and a workpiece will not be ground deeply and the ultra micro work becomes easy. Furthermore, if the invention is applied to an assembly of micro components of a micro machine or to a control of the distribution of non-magnetic particles such as diamond particles used by a micro decorating work, the assembly or decorating work can be simplified. Since the invention method does not handle particles by suction of a magnetic force, the handling of non-magnetic particles becomes very easy.

What is claimed is:

1. A method of arranging non-magnetic substances, comprising the steps of:

coating a magnetic fluid mixed with the non-magnetic substances on a surface of a magnetic recording medium recorded with a magnetic pattern; and applying a uniform d.c. magnetic field or an a.c. magnetic field superposed upon the d.c. magnetic field to the surface of the magnetic recording medium to form the non-magnetic substances in an in-plane of the magnetic recording medium or cubically on the magnetic recording medium.

2. A method of arranging non-magnetic substance according to claim 1, wherein the d.c. magnetic field is applied to the surface of the magnetic recording medium horizontally or vertically.

3. A method of arranging non-magnetic substance according to claim 2, wherein the non-magnetic substances are non-magnetic substance particles.

4. A method of arranging non-magnetic substance according to claim 1, wherein the non-magnetic substances are non-magnetic substance particles.

5. A method of arranging non-magnetic substance according to claim 1, wherein the non-magnetic substances are non-magnetic substance particles, and the non-magnetic substance particles are arranged in the form of non-magnetic substance chains in the in-plane under the conditions of $1 \leqq \lambda/d \leqq 10$ where d is the diameter of the non-magnetic substance particle and $\lambda$ is a arrangement interval between non-magnetic substance particle chains.

6. A method of arranging non-magnetic substance according to claim 1, wherein the non-magnetic substances are non-magnetic substance particles, and the non-magnetic substance particles are arranged in the form of cubic non-magnetic substance chains under the-conditions of $\lambda/d \leqq 10$ where d is the diameter of the non-magnetic substance particle and $\lambda$ is a arrangement interval between cubic non-magnetic substance particle chains.

7. A method of arranging non-magnetic substance according to claim 1, wherein the surface of the magnetic recording medium is a flat surface or a curved surface.

8. A method of arranging non-magnetic substance according to claim 7, wherein the non-magnetic substances are non-magnetic substance particles.

9. A method of arranging non-magnetic particles on a substrate, the substrate including a magnetic recording medium, the method comprising the steps of:

providing a mixture of magnetic fluid and non-magnetic particles;

recording a magnetic pattern on the magnetic recording medium, wherein an arrangement interval of said magnetic pattern is greater than or equal to a diameter of individual ones of the non-magnetic particles;

subsequent to the recording step, coating a surface of the recording medium with said mixture to form a film on the surface of the recording medium;

applying a d.c. magnetic field to the surface of the magnetic recording medium to arrange the non-magnetic particles of the film in an array on the surface of the magnetic medium, the configuration of the array of non-magnetic particles being established by said magnetic pattern; and solidifying the film.

10. A method according to claim 9, wherein a ratio of the arrangement interval to the particle diameter is within a range of approximately 1:1 to 10:1, and the array is a planar array.

11. A method according to claim 9, wherein a ratio of the arrangement interval to the particle diameter is greater than 10, and the array is cubicle.

12. A method according to claim 9, further comprising a step of applying an a.c. magnetic field concurrently with said applying of the d.c. magnetic field, wherein the a.c. magnetic field is superposed on the d.c. magnetic field.

13. A method according to claim 9, wherein the d.c. magnetic field is uniform.

14. A method according to claim 9, wherein the magnetic pattern of said recording step is periodic resulting in periodic stripes of the magnetic pattern.

15. A method according to claim 9, wherein the non-magnetic particles are abrasive, and the step of solidifying the film produces a grinding surface.

* * * * *